US005419288A

United States Patent [19]

Dale

[11] Patent Number: 5,419,288

[45] Date of Patent: May 30, 1995

[54] SPHERICAL PISTON RADIAL ACTION ENGINE

[76] Inventor: Thomas W. Dale, 157 Hughes Pl., Albertson, N.Y. 11507

[21] Appl. No.: 213,040

[22] Filed: Mar. 15, 1994

[51] Int. Cl.[6] ..... F02B 57/04

[52] U.S. Cl. ..... 123/44 B; 123/44 E; 123/234

[58] Field of Search ..... 123/44 R, 44 B, 44 E, 123/223, 234; 92/177, 179; 60/39.6, 39.63

[56] References Cited

U.S. PATENT DOCUMENTS 4,336,686 6/1982 Porter ..... 60/39.63
5,080,050 1/1992 Dale ..... 123/44 E
5,257,599 11/1993 Dale ..... 123/44 B

*Primary Examiner*—Richard A. Bertsch
*Assistant Examiner*—Charles G. Freay
*Attorney, Agent, or Firm*—Galgano & Burke

[57] ABSTRACT

A rotary internal combustion engine comprising a housing containing a rotatable cylinder having a circular wall containing at least two rows of radially extending circular passageways forming compression and power engine cylinders, respectively, displaced from each other along the axis of rotation. Each of the engine cylinders contains a freely reciprocal and rotatable spherical piston. A stationary cam is mounted within the housing surrounding each of the rows of engine cylinders, each cam consisting of a pair of edges circular in diameter whose axis coincides with the axis of rotation of the rotatable cylinder. Each pair of edges is in contact with all of the spherical pistons within its respective row, the spacing of the edges varying over 360 degrees of rotation so that the spherical pistons move at a uniform velocity within each cylinder.

10 Claims, 10 Drawing Sheets

SPHERICAL PISTON RADIAL ACTION ENGINE

BACKGROUND OF THE INVENTION

The present invention relates to a radial internal combustion engine with spherical pistons having a unique cam configuration to establish relative constant velocity reciprocation of the pistons.

In my patent application entitled "Four Stroke Continuous Cycle Radial Piston Engine", Ser. No. 094,708 filed on Jul. 22, 1993, which is a continuation-in-part of Ser. No. 889,439 filed on May 28, 1992, now U.S. Pat. No. 5,257,599, I describe a radial internal combustion engine with spherical pistons which ride on a circular cam surface whose center of rotation is offset from the center of rotation of the cylinders. The spherical pistons, in addition to rolling around on the cam surface in a circular motion, also have reciprocating motion relative to the cylinders. The velocity of each of the pistons along its circular path as well as the relative reciprocation varies significantly over the cycle of rotation.

The non-uniform velocity of the pistons along their circular paths results in some sliding and slipping of the spherical pistons instead of pure rolling motion along the cam surface during velocity changes. This causes extra wear due to friction and increased noise. In addition, the non-uniform motion can be shown to cause the pistons to "bunch up" in one portion of each cycle resulting in an unbalancing effect and increased vibration in the engine.

SUMMARY OF THE INVENTION

In the present invention, there is provided a spherical piston radial internal combustion engine in which a unique cam construction produces a uniform rolling motion of each piston along the circular path and constant relative reciprocating motion within each cylinder.

The radial internal combustion engine employing spherical pistons in accordance with the principles of this invention lacks the conventional trunk pistons, connecting rods, crankshaft or other oscillating running gear. Instead it contains a cylinder rotor with two or more rows of radially extending cylinders. In each cylinder a spherical piston rides on a track concentric to the rotor, resulting in substantially uniform reciprocating motion.

The cylindrical rotor containing a plurality of rotating cylinders while the spherical piston within each cylinder rolls around the inside wall of the engine housing along a uniquely designed cam in another circle and is held that way by centrifugal force. The two circles just described are dimensionally concentric to each other with the result that each spherical piston reciprocates within its own cylinder. The cam is configured to insure substantially uniform reciprocal motion of each spherical piston within its cylinder.

Separate cylinders are provided for compression. (hereinafter compression cylinders) and for ignition, combustion and expansion (hereinafter power cylinders).

The spherical pistons in the compression cylinders perform the function of aspirating and compressing the intake air. In one revolution all the spherical pistons in the compression cylinders go through an intake stroke, a compression stroke, and then passes the compressed air outside the engine to an intercooler.

The compressed air with fuel added is then transferred via a transfer tube to the power cylinders. After receiving the air-fuel charge from the transfer tube the cylinders and pistons of the power cylinders pass over a flame tube for igniting the entrapped charge.

The power cylinders cam is aligned so that at ignition the piston starts its outward movement. After complete expansion of the gas during the power stroke, the exhaust port is exposed and the spherical pistons move inwardly, expelling the combustion products. The power cylinder dimensions and piston stroke are chosen to achieve complete expansion of the waste products. In a preferred embodiment, two rows of power cylinders are used with one row of compression cylinders.

In this invention, slipping and sliding as well as bunching up of the spherical pistons as previously described can be significantly reduced.

It is thus a principal object of this invention to provide a spherical piston notary internal combustion engine with improved control over the motion of the spherical pistons.

Other objects and advantages of this invention will hereinafter become obvious from the following description of preferred embodiments of this invention.

Figure 1:
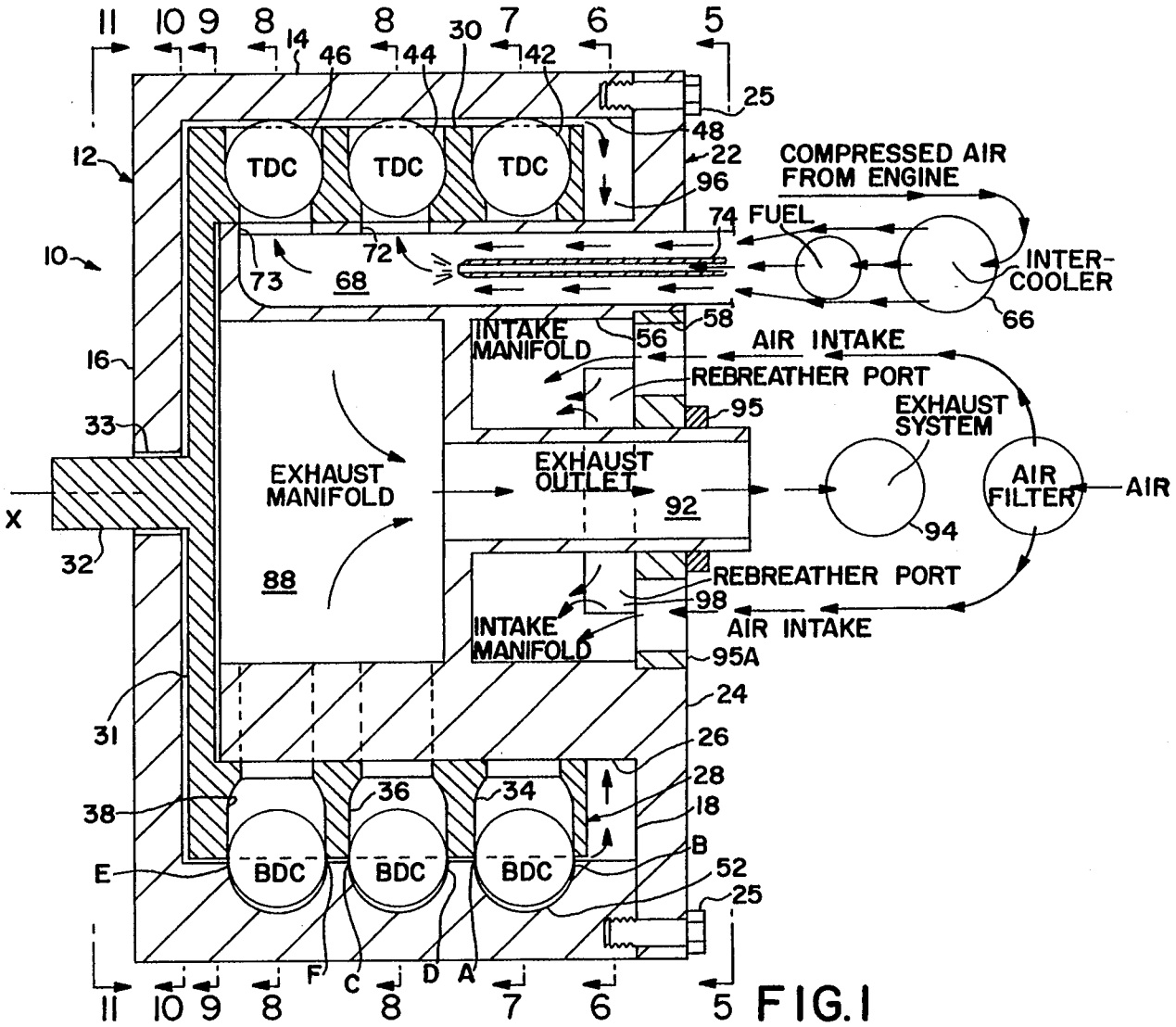
FIG. 1 is an elevation view in section of an internal combustion engine, partially schematic, embodying the principles of this invention, with the pistons at bottom and top dead center, taken along 1—1 of FIG. 7.

The arrows illustrated throughout the figures show direction of the rotating members and direction of flow of the various fluids described.

DESCRIPTION OF THE PREFERRED EMBODIMENTS

Referring to FIGS. 1, 2, and 5 to 11, internal combustion engine 10 comprises a stationary cylindrical housing 12 with an outer wall 14, end wall 16, and a circular opening 18. The latter is covered by a closure 22 comprising an end plate 24 attached by bolts 25 to housing 12 and a cylindrically shaped stator 26 extending into housing 12.

In the annular space between stator 26 and outer wall 14 of housing 12 is rotor 28 having a cylindrical wall 30, an end wall 31, and an output shaft 32 extending out through opening 33 in end wall 16 of housing 12 for delivering the shaft output of engine 10.

Formed within wall 30 of rotor 28 are three rows of an annular array of spaced cylinders 34, 36, and 38 in which each are spherical pistons 42, 44, and 46, respectively.

Figure 7:
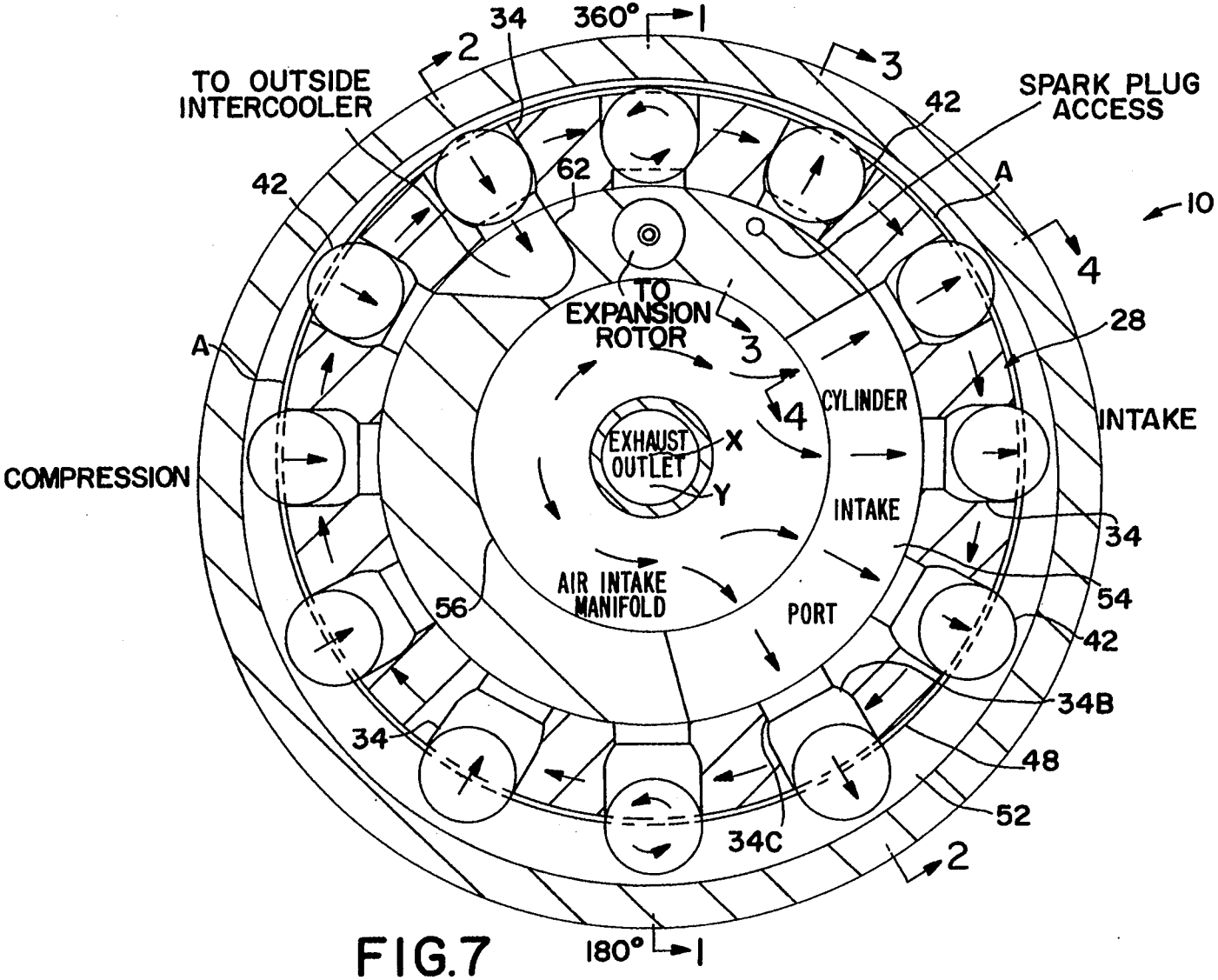
FIG. 7 is a section taken along 7—7 of FIG. 1.

Referring also to FIG. 7, each cylinder, for example, cylinder 34, consists of a radially extending circular bore with a spherical shoulder **34*b* to match spherical piston 42 as illustrated, and a throat 34***c*, so that cylinder 34 completely penetrates wall 30 of rotor 28 as shown.

Cylinders 34 are described herein as compression cylinders while cylinders 36 and 38 are described herein as power cylinders for reasons which will be seen from the following discussion.

The inside surface 48 of housing wall 14 is provided with a unique cam construction on which spherical pistons 42 ride. This construction consists of a pocket 52 (see also FIG. 1) in surface 48 for a purpose to be described below. Both inner surface 48 of housing wall 14 and the outer surface of rotor wall 30 are circular and have the same axis X of rotation.

Axis Y, which is offset from axis X as seen in FIG. 7, is the center for the circular outer surface of housing 14. The width of the opening into pocket 52, seen in FIGS. 1 and 1A, which is the distance between the outer edges A and B of pocket 52, is designed to vary over the circumference of inner surface 48 in such a way as to permit pistons 42 to appear to move at a uniform rate of speed within each cylinder 34 as rotor 28 turns. If desired, the distance between outer edges A and B may be varied over the circumference to obtain any other desired relative movement of the pistons within their respective cylinders.

It should be noted that the spherical pistons are not actually reciprocating. They are orbiting in a near circular path but only within each cylinder do they appear to be reciprocating.

The depth of pocket 52 in housing wall 14 varies over the circumference to accomodate the pistons, and the same configuration is true for pistons 44 and 46. Edges A and B, forming a track on which the spherical pistons roll, are located on the inner surface 48 of housing wall 14.

Figure 1A:
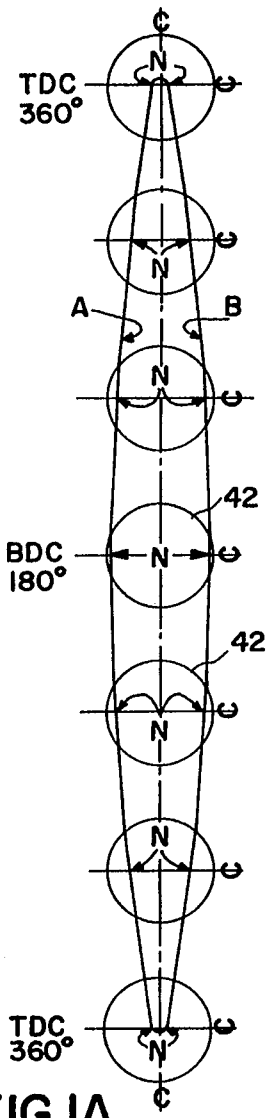
FIG. 1A is a schematic illustration of the path of a spherical piston over 360 degrees of rotation.
Figure 2:
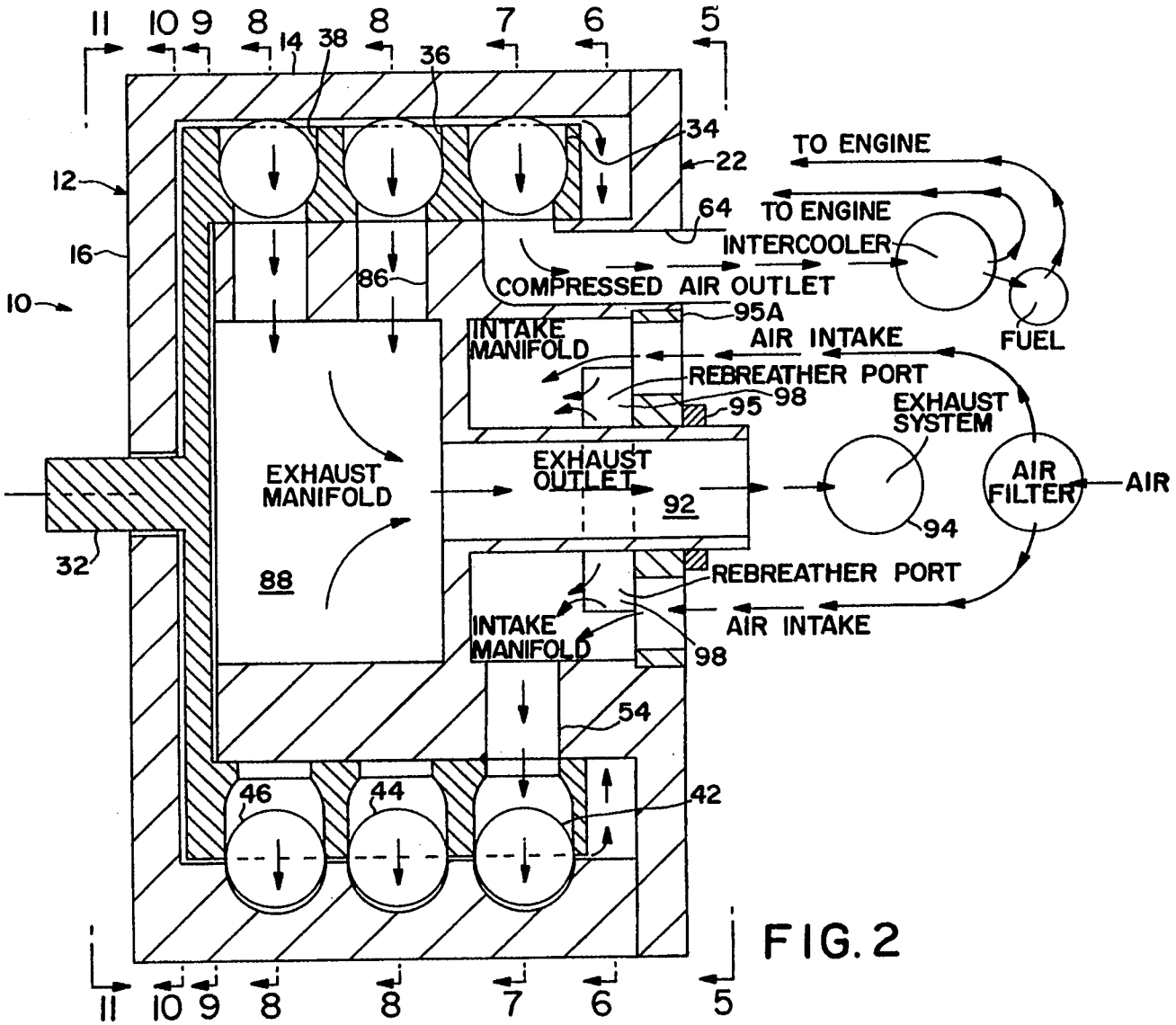
FIG. 2 is a section taken along 2—2 of FIG. 5.

Spherical pistons 42 ride and spin on edges A and B as rotor 28 turns, as shown schematically in FIG. 1A, so that as the width changes spherical pistons 42 reciprocate within cylinders 34.

Centrifugal force maintains pistons 42 in contact with edges A and B. Pistons 42 never touch any part of pocket 52 other than edges A and B as shown in the figures. Pistons 42 while rotating about edges A and B are also moving in a planetary orbit as previously described.

It will be seen from FIGS. 1, 2, 3, 4, and 7, that as rotor 28 turns, from TDC to BDC, pistons 42 are moving outwardly so that air is entering cylinders 34 through an air intake port 54 located in stator 26 during a portion of this cycle. Stator 26 is also provided with air intake manifold 56 which receives fresh air from a plurality of air intake ports 58 shown also in FIG. 5.

From BDC to TDC, pistons 42 are moving inwardly thereby compressing the air until the compressed air is discharged through a port 64 in stator 26 just prior to TDC. The compressed air leaves stator 26 by way of compressed air outlet port 64 (FIG. 5) for passage through an intercooler 66 shown schematically in FIG. 1. Intercooler 66 is of conventional design utilizing ambient air to cool the compressed air.

Figure 8:
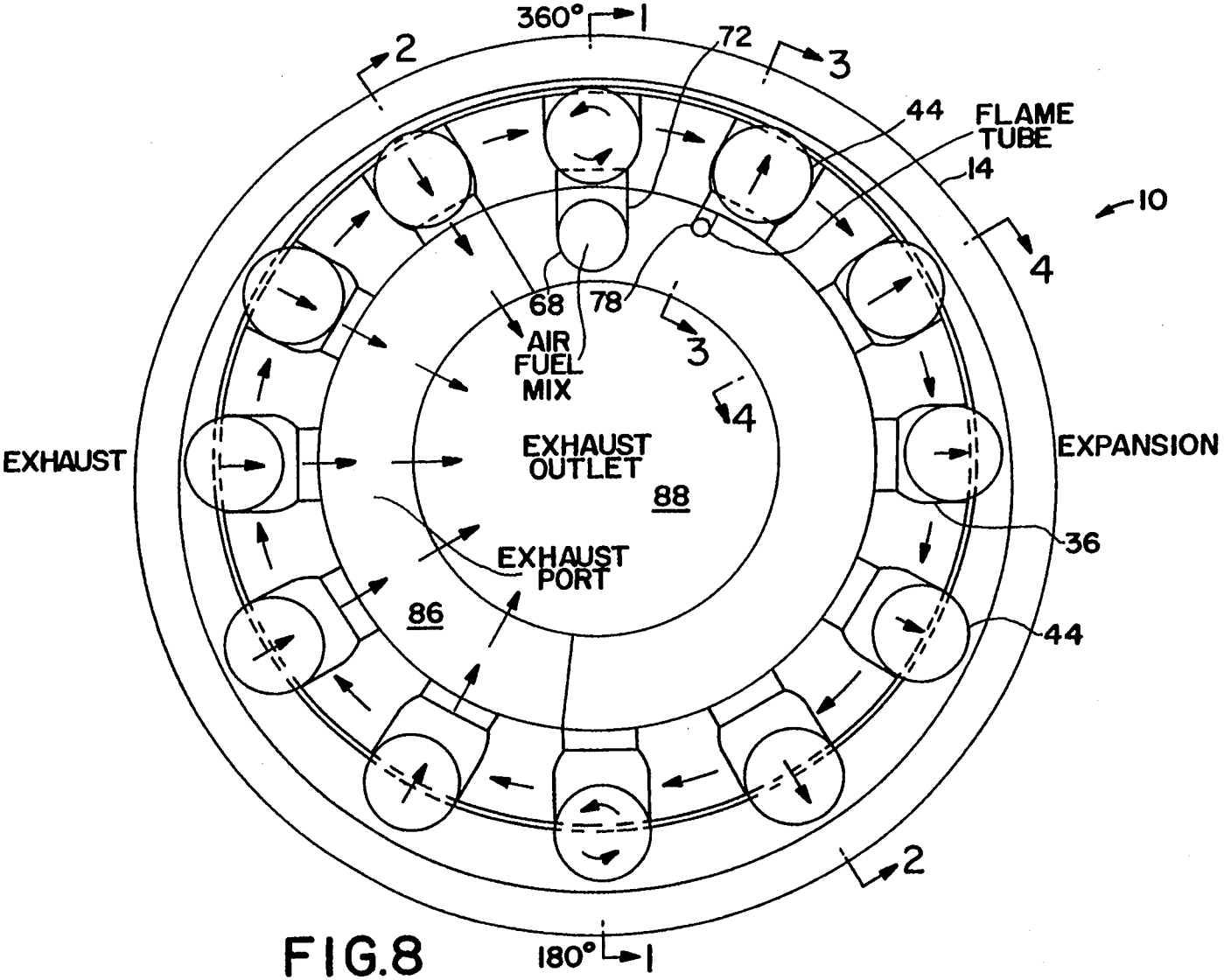
FIG. 8 is a section taken along 8—8 of FIG. 1.
Figure 9:
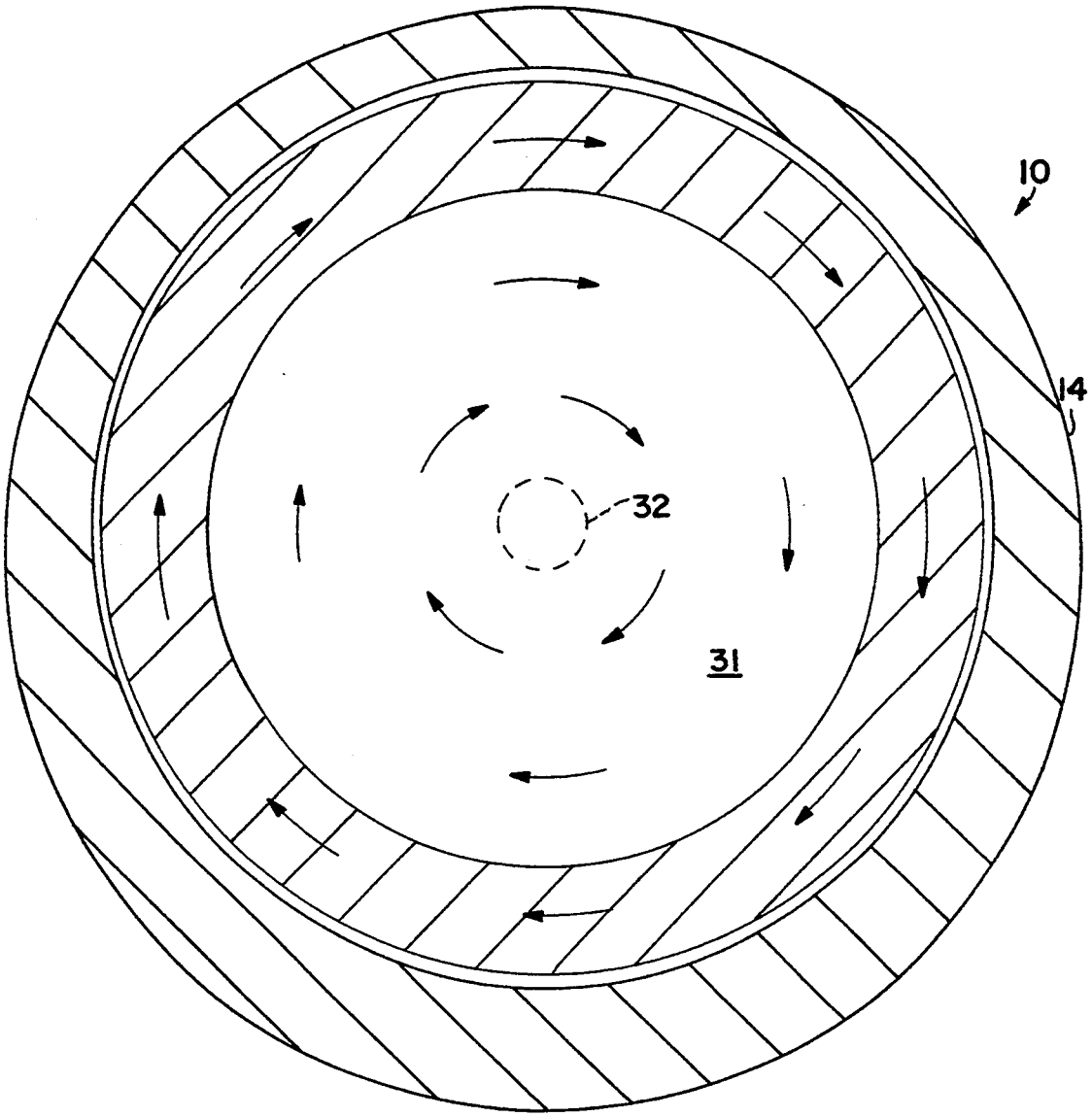
FIG. 9 is a section taken along 9—9 of FIG. 1.
Figure 10:
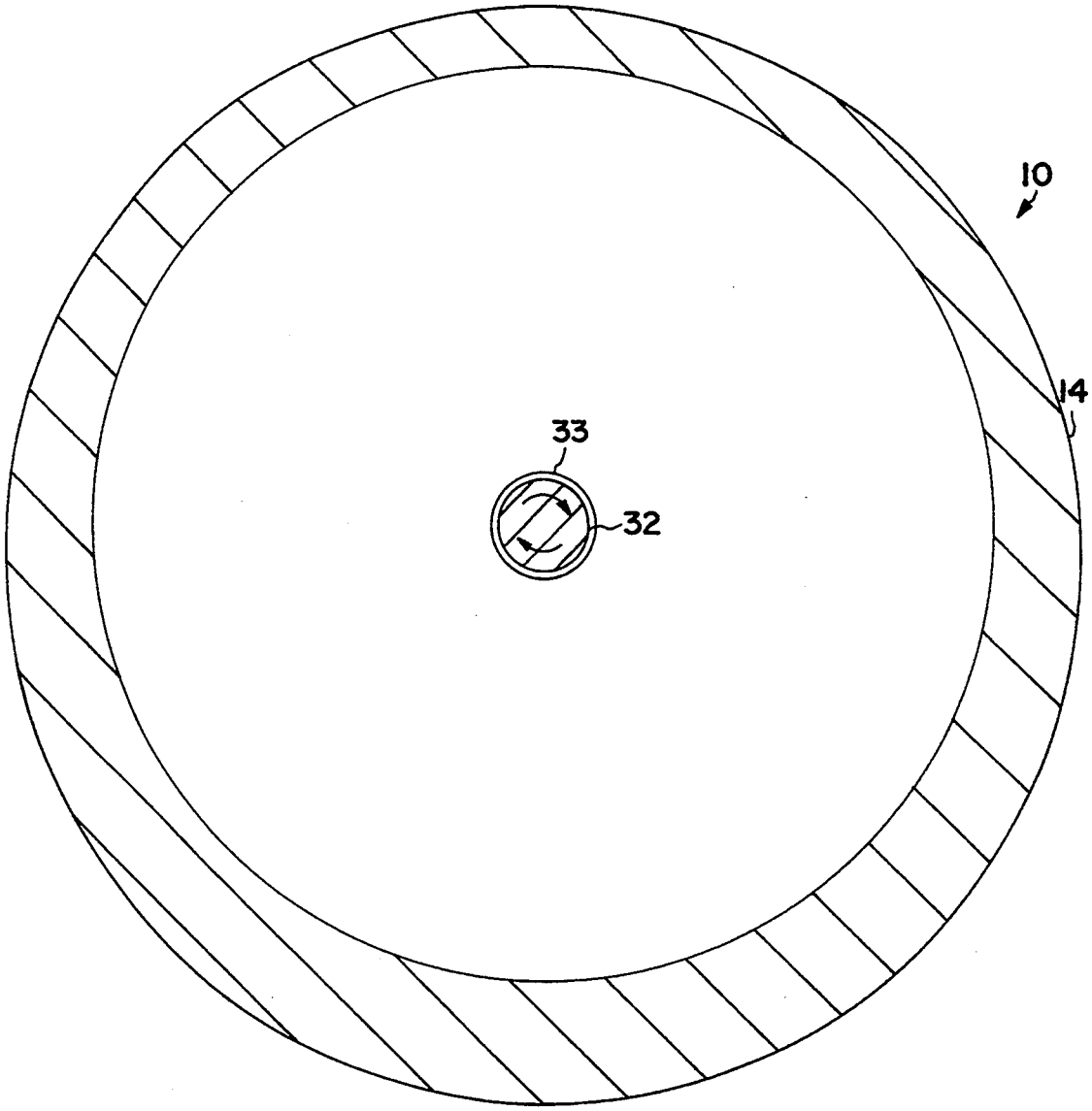
FIG. 10 is a section taken along 10—10 of FIG. 1.
Figure 11:
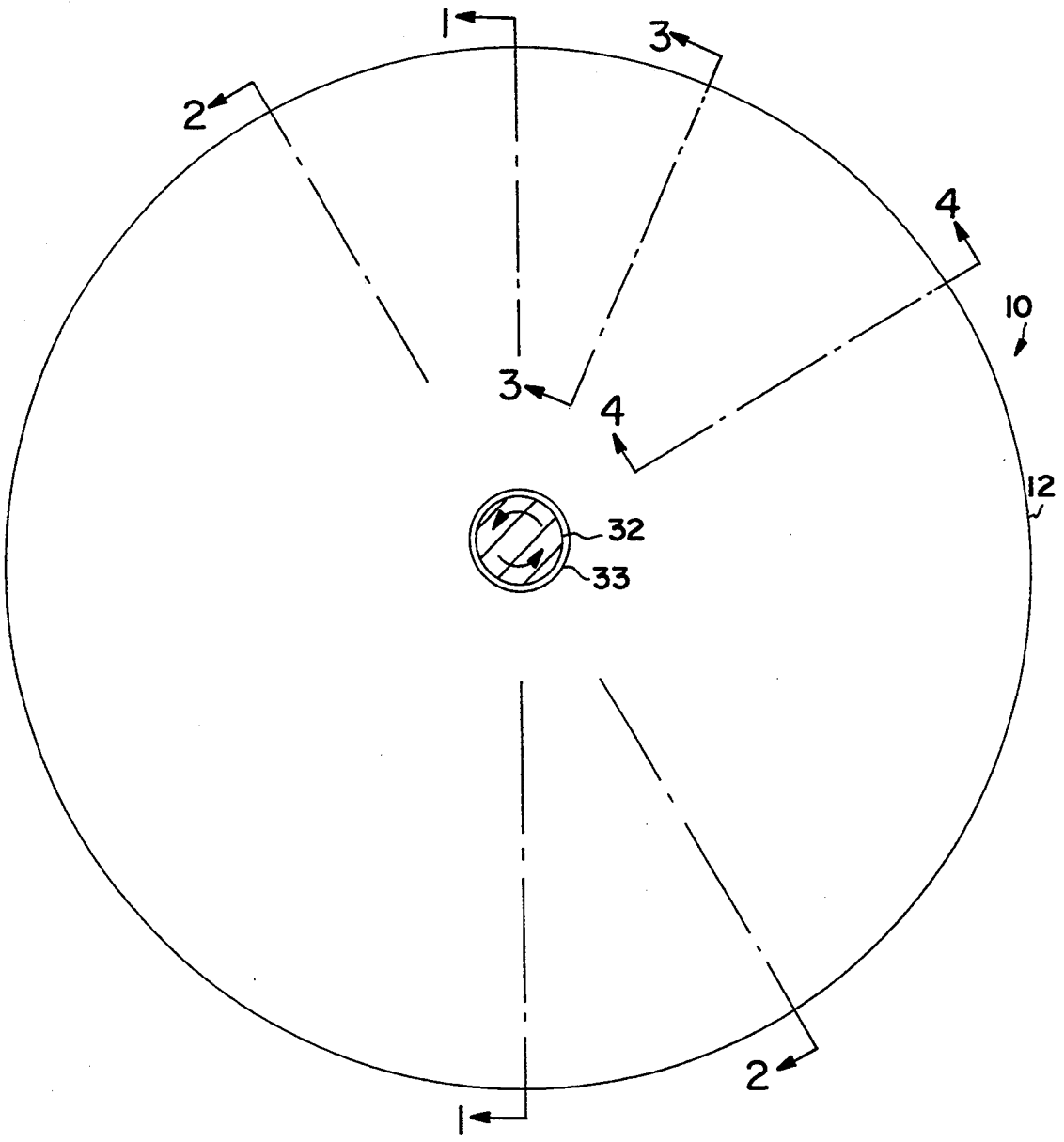
FIG. 11 is a view taken along 11—11 of FIG. 1.

Referring to FIGS. 1 and 8, power cylinders 36 and 38 received compressed air from intercooler 66 by way of fuel-air manifold 68 in stator 26 and ports 72 and 73 at TDC. Fuel is injected into the compressed air by one or more injectors 74 located in fuel-air manifold 68.

Figure 3:
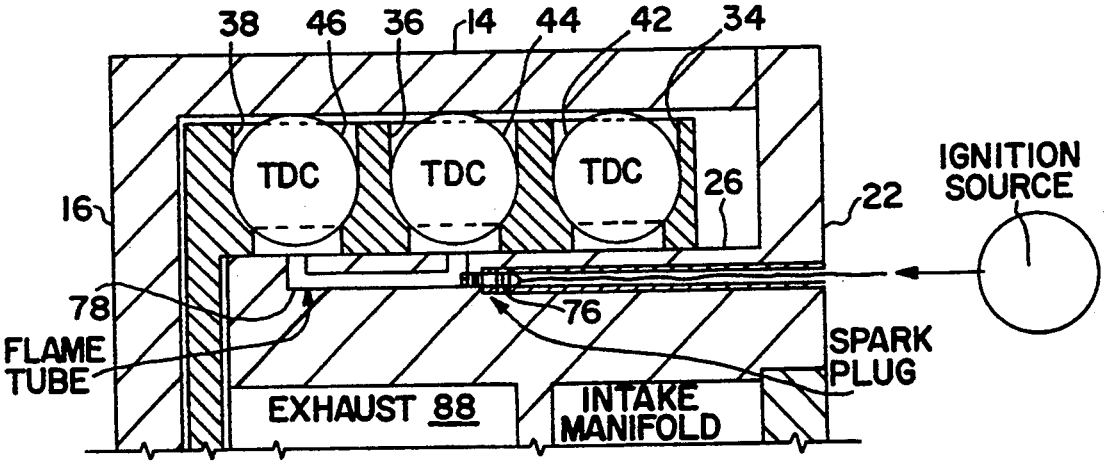
FIG. 3 is a section taken along 3—3 of FIG. 5.
Figure 4:
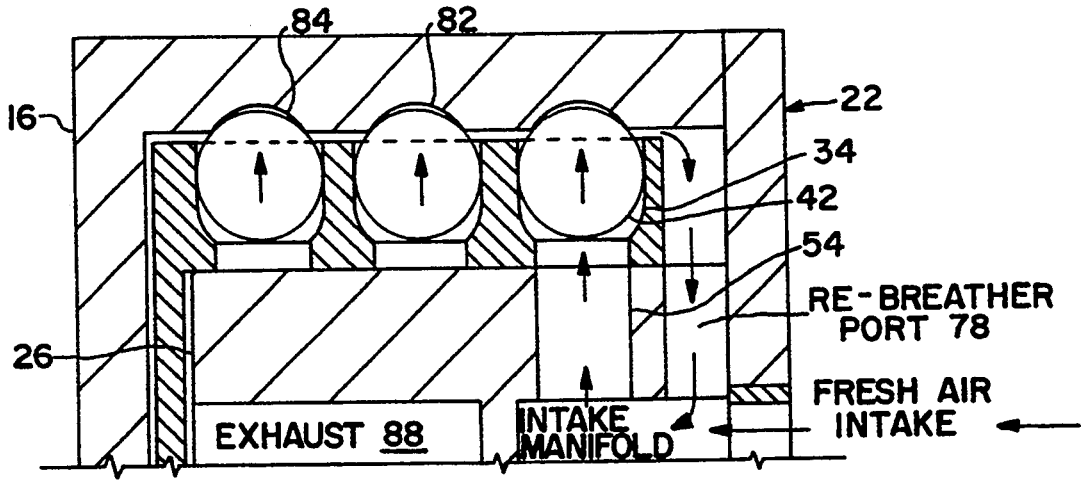
FIG. 4 is a section taken along 4—4 of FIG. 5.
Figure 5:
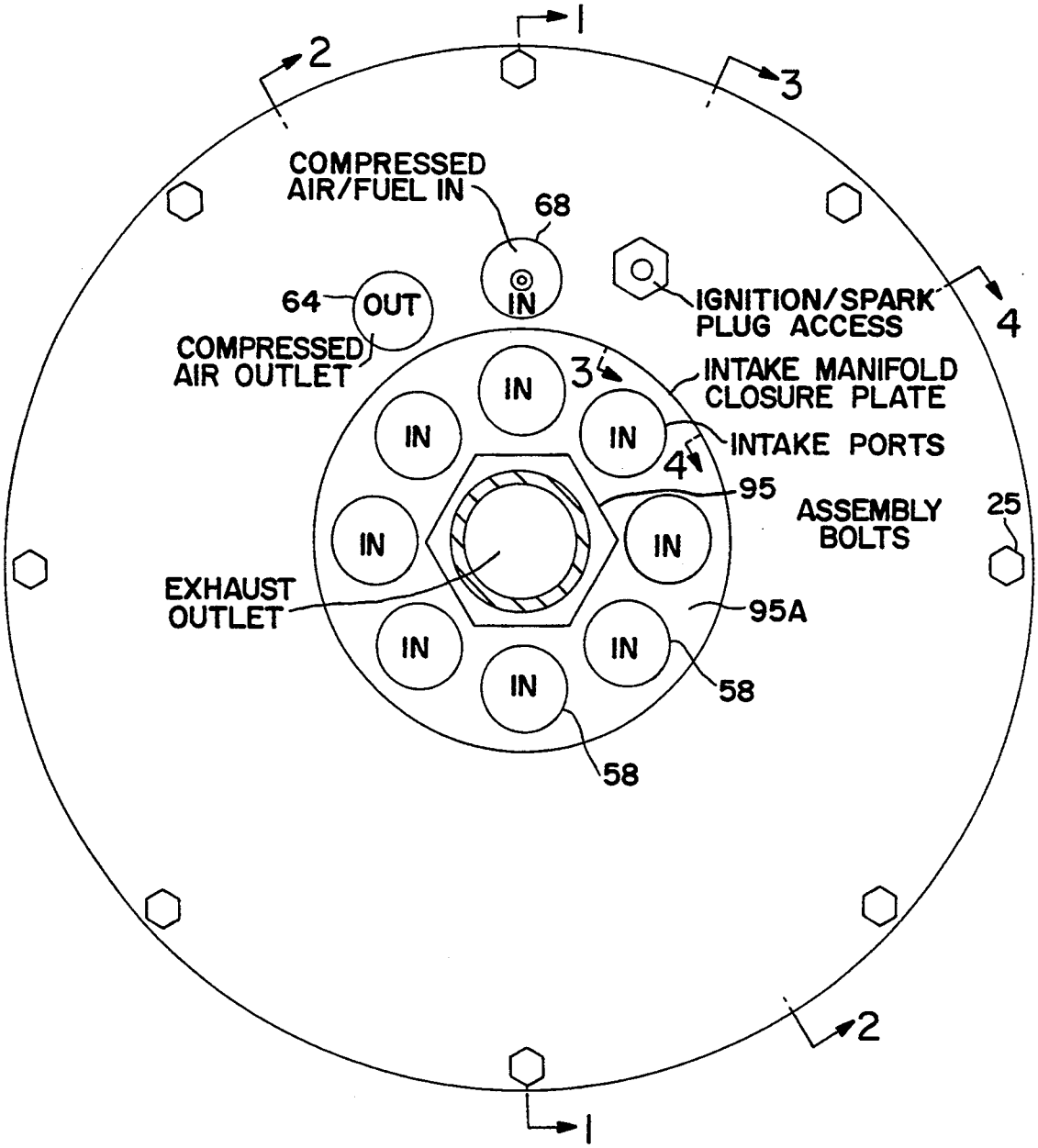
FIG. 5 is a view taken along 5—5 of FIG. 1.

As seen in FIG. 3, ignition is provided by a spark plug 76 located in a flame tube 78 in stator 26 open to cylinders 36 and 38 through ports 72 and 73 at TDC.

In cylinders 36 and 38, spherical pistons 44 and 46 are provided with similar camming edges C and D, and E and F, respectively, on pockets 82 and 84, respectively as previously described.

From TDC to BDC, the expansion power stroke takes place with exhaust occurring afterwards as illustrated in FIG. 8 through exhaust port 86 until shortly before TDC. The exhaust products are discharged through exhaust manifold 88 and exhaust outlet 92 to exhaust system 94. A nut 95 mounted on outlet 92 holds plate 95*a* containing air intake ports 58.

Figure 6:
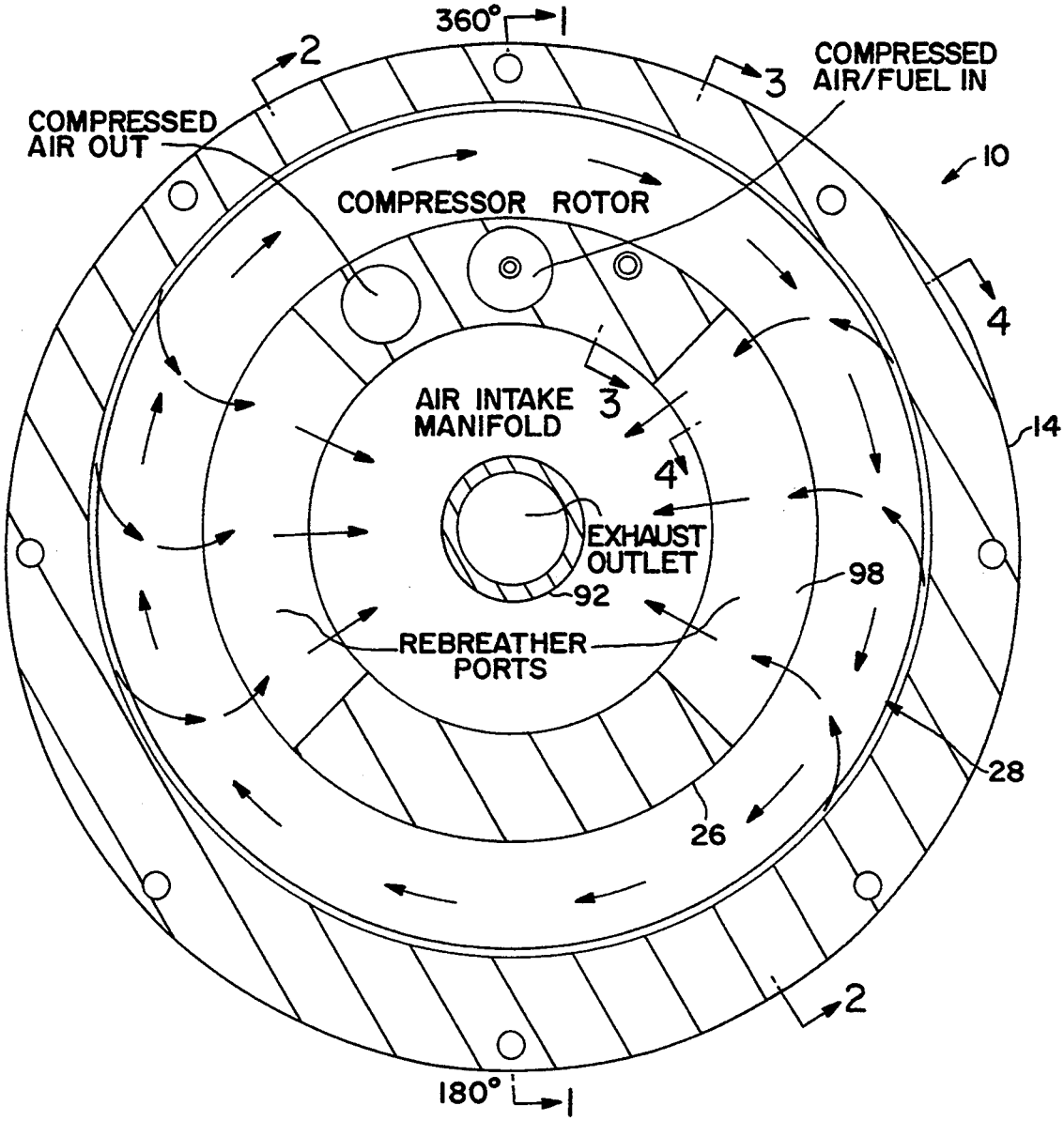
FIG. 6 is a section taken along 6—6 of FIG. 1.

As seen also in FIG. 6, gases escaping past pistons 42, 44, and 46 pass into annular chamber 96 and through a rebreather port 98 into intake manifold 56 for recycling. The spherical pistons and the cylinders are designed with a clearance to permit leakage thereby reducing friction to a minimum.

The greatest area to area contact takes place between the inner surface of rotor 28 and the outer surface of stator 26. The cross sectional area of each cylinder, for example, cylinder 34, above spherical section 34*b*, is double that of the cross sectional area of throat 34*c*. This results in a balancing of forces between the rotor 28 and stator 26 and a further reduction in friction.

In the operation of engine 10, power cylinders 36 and 38 containing spherical pistons 44 and 46, respectively, during their expansion strokes as described above exert force on their respectively camming edges C,D and E,F causing rotor 28 to turn and deliver the power through shaft 32 and provide air compression in cylinders 34.

This unique cam construction permits the spherical pistons to build up rotational kinetic energy during 180 deg. from TDC to BDC as the contact points move out on each sphere, much like the operation of a "yo-yo". This kinetic energy is then used to help the pistons move inwardly against centrifugal forces during the next 180 deg.

The mechanical design of the engine lends itself to inherently smooth operation. By eliminating the crankshaft and connecting rods the normal vibration induced by their motion is eliminated.

Using a ported cylindrical stator for the charge supply and exhaust manifolds allows the engine to operate on the four stroke mechanical cycle without the use of intake or exhaust valves. The seal between the rotor and the stator is maintained by controlling the clearance and selecting a cylinder counter bore effective area (ie, throat 34*c*) equal to one-half the cylinder bore area, as previously described. The effect of this is to create an equilibrium condition at the interface of the rotor and stator The result is that under all operating conditions, positive or negative cylinder pressure, the force of the rotor on the stator is essentially balaanced out, thereby reducing rotor-stator interface wear. This feature is important for long term sealing control.

While only certain preferred embodiments of this invention have been described it is understood that many variations of this invention are possible within the scope of the claims which follow.

What is claimed is:

1. A rotary internal combustion engine comprising:

a. a stationary housing;

b. rotatable cylindrical means comprising a circular wall containing at least two rows of radially extending circular passageways forming compression and power engine cylinders, respectively, displaced from each other along the axis of rotation, each of said engine cylinders penetrating completely said wall;

c. stationary core means within said housing and enclosed by the circular wall of said rotatable cylindrical means for supplying, transferring, and carrying away working fluid to and from said cylinders;

d. each of said engine cylinders containing a freely reciprocal and rotatable spherical piston; and e. stationary cam means comprising a circular track formed by a pair of spaced edges mounted within said housing surrounding each of said rows of engine cylinders, each stationary cam means including means in contact with each of said pistons to cause said spherical pistons to reciprocate within their respective engine cylinders as said rotatable cylinder means rotates; and f. shaft means connected to said rotatable cylindrical means to deliver the output shaft power of said engine.

2. A rotary internal combustion engine comprising:– a. a stationary housing;

b. rotatable cylindrical means comprising a circular wall containing at least two rows of radially extending circular passageways forming compression and power engine cylinders, respectively, displaced from each other along the axis of rotation, each of said engine cylinders penetrating completely said wall;

c. stationary core means within said housing and enclosed by the circular wall of said rotatable cylindrical means for supplying, transferring, and carrying away working fluid to and from said cylinders;

d. each of said engine cylinders containing a freely reciprocal and rotatable spherical piston; and e. stationary cam means comprising a circular track formed by a pair of edges, said circular track having an axis coinciding with the axis of rotation of said rotatable cylindrical means, each pair of edges being in contact with all of the spherical pistons within its respective row, the spacing of said edges varying over 360 degrees of rotation being such as to enable said spherical pistons to reciprocate within their respective cylinders, said track being mounted within said housing surrounding each of said rows of engine cylinders; and f. shaft means connected to said rotatable cylindrical means to deliver the output shaft power of said engine.

3. The rotary engine of claim 2 in which said pistons are sized in said cylinders so as to permit some gases to escape past said pistons and having means to recirculate such escaping gases into intake air entering said compression cylinders.

4. The rotary internal combustion engine of claim 2 in which each of said engine cylinders narrows down to form a circular throat of reduced diameter to communicate with said stationary core means.

5. The rotary engine of claim 4 wherein the cross sectional area of each engine cylinder is about double the cross sectional area of its throat.

6. The rotary engine of claim 5 in which said stationary core means includes means to deliver air to said compression engine cylinders where said air is compressed as said stationary cam means in contact with the spherical pistons causes the latter to move inwardly within the respective cylinders during a portion of the cycle of rotation, means to inject fuel into and transfer said compressed air to said power engine cylinders during another portion of the cycle of rotation for combustion and expansion within said power cylinders, and means to withdraw the products of expansion from said power cylinders during another portion of the cycle of rotation, the combustion products expanding in said power cylinders causing said pistons within said power cylinders to work against said stationary cam means thereby causing said rotatable cylinder means to rotate and cause said stationary cam means in contact with the spherical pistons in said compression engine cylinders to compress the air therein.

7. The rotary internal combustion engine of claim 6 in said stationary core means includes means to ignite the compressed air containing fuel being delivered to said power cylinders.

8. The rotary engine of claim 7 having means to cool the compressed air entering said power cylinders.

9. A rotary machine comprising:

a. a stationary housing;

b. rotatable cylindrical means within said housing comprising a cylindrical wall containing a row of radially extending circular power machine cylinders, each of said machine cylinders penetrating completely said wall;

c. stationary core means within said housing and enclosed by the circular wall of said rotatable cylindrical means for supplying and carrying away Working fluid to and from said cylinders;

d. each of said machine cylinders containing a freely reciprocal and rotatable spherical piston and communicating with said stationary core means;

e. stationary cam means mounted within said housing surrounding said row of machine cylinders for camming each of said spherical pistons, said camming means comprising a pair of spaced edges following a path circular in diameter, the axis of said path coinciding with the axis of roatation of said rotatable cylinder means, said pair of edges being in contact with said spherical pistons, the spacing of said edges varying in a manner to produce a preselected type of motion of said pistons within their respective cylinders; and f. shaft means connected through said housing to said rotatable cylindrical means for providing direct physical connection said rotating machine cylinder means.

10. The machine as described in claim 9 in which each of said cylinders narrows down to form a circular throat of reduced diameter.

* * * * *